US005179738A

United States Patent [19]

Sowards

[11] Patent Number: 5,179,738

[45] Date of Patent: Jan. 19, 1993

[54] R. V. TOILET VENTING SYSTEM

[76] Inventor: Edward W. Sowards, 160 Ridge Rd., Ben Lomond, Calif. 95005

[21] Appl. No.: 728,283

[22] Filed: Jul. 11, 1991

[51] Int. Cl.[5] ..... E03D 9/052

[52] U.S. Cl. ..... 4/213; 4/216

[58] Field of Search ..... 4/209 FF, 210, 211, 4/213, 216, 218, 321, 323

[56] References Cited

U.S. PATENT DOCUMENTS

| | | | |
|---|---|---|---|
| 1,290,615 | 1/1919 | McGary | 4/210 |
| 2,728,921 | 1/1956 | Dorko | 4/216 |
| 3,059,245 | 10/1962 | Bell | 4/213 |
| 3,122,757 | 3/1964 | Sowards | 4/213 |
| 3,681,790 | 8/1972 | Dooley | 4/216 |
| 3,938,201 | 2/1976 | McGrew | 4/213 |
| 4,318,192 | 3/1982 | Williams et al. | 4/213 |
| 4,922,557 | 5/1990 | Harding et al. | 4/477 |

*Primary Examiner*—William A. Cuchlinski, Jr.

*Assistant Examiner*—W. Morris Worth

*Attorney, Agent, or Firm*—Jacobson, Price, Holman & Stern

[57] ABSTRACT

A remotely operable exhaust blower is operatively associated with the upper discharge end of the vent pipe of a recreational vehicle holding tank. A vent line including an inlet end and an outlet end is provided with its outlet end opening downwardly into a closed passage which communicate the waste outlet of the toilet with the inlet of the holding tank. The inlet end of the vent line is communicated with the flushing water supply passage for the toilet bowl through the utilization of a float-type liquid flow preventing valve which allows downstream flow of odors and gases therethrough, prevents downstream flow of liquid under pressure therethrough and prevents upstream flow of gases therethrough in the absence of water pressure in the flushing water supply pipe upstream from the valve.

7 Claims, 2 Drawing Sheets

R. V. TOILET VENTING SYSTEM

BACKGROUND OF THE INVENTION

1. Field of the Invention

This invention relates to an R.V. toilet venting system including an exhaust blower on the upper end of the vent pipe of the system for drawing gases from above the liquid level in the holding tank of the system and further including a vent line, incorporating a float-type liquid flow preventing valve, having an inlet end for receiving gases from the interior of the associated toilet bowl and an outlet end opening into the base of the toilet bowl downstream from the flushing valve thereof, the exhaust blower thereby being operative to exhaust gases from the toilet bowl through the upper portion of the toilet holding tank and upwardly and out the vent pipe for the holding tank.

2. Description of Related Art

Various different forms of toilet bowl venting systems heretofore have been provided for exhausting gases from within an associated toilet bowl and or exhausting gases from a toilet facility through the utilization of an exhaust blower mounted atop a vertical vent pipe of the facility. Examples of these previously known devices are disclosed in U.S. Pat. Nos. 3,681,790, 4,318,192 and 4,922,557. However, these previously known devices do not include the overall combination of structural and operational features of the instant invention.

SUMMARY OF THE INVENTION

The R.V. toilet venting system of the instant invention utilizes the existing upstanding vent pipe for the associated R.V. toilet holding tank and mounts an exhaust blower atop the vent tank. In addition, a vent line is also provided and includes an inlet end communicated with the outlet end of the flushing water supply line for the associated toilet bowl through a float-type liquid flow preventing valve and an outlet end communicated with the interior of the R.V. toilet downstream from the bowl discharge valve thereof. The electrical control for the exhaust blower is to comprise a wall mounted electrical switch readily accessible to a person seated upon the associated R.V. toilet.

The main object of this invention is provide an R.V. toilet venting system which will be effective to vent gases from the toilet bowl of an R.V. through the upper portion of the holding tank for the R.V. toilet and the upstanding vent pipe of the holding tank.

Another object of this invention is to provide a toilet venting system in accordance with the preceding objects and which may be readily incorporated into an existing R.V. toilet system.

Yet another object of this invention is to provide an R.V. toilet venting system which also may be incorporated into the manufacture of new R.V. toilets.

Still another object of this invention is to provide an R.V. toilet venting system which may be actuated, whenever desired.

A final object of this invention to be specifically enumerated herein is to provide an R.V. toilet venting system in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout

DESCRIPTION OF THE PREFERRED EMBODIMENT

Figure 1:
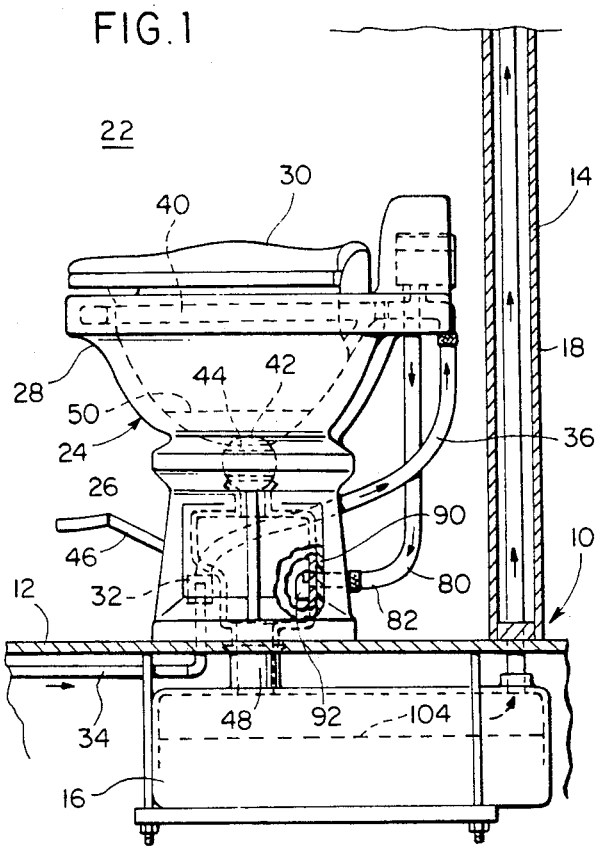
FIG. 1 is a side elevational view of a typical R.V. toilet venting system with the adjacent floor and wall portions of the associated R.V. and base portion of the R.V. toilet being broken away and illustrated in vertical section.
Figure 2:
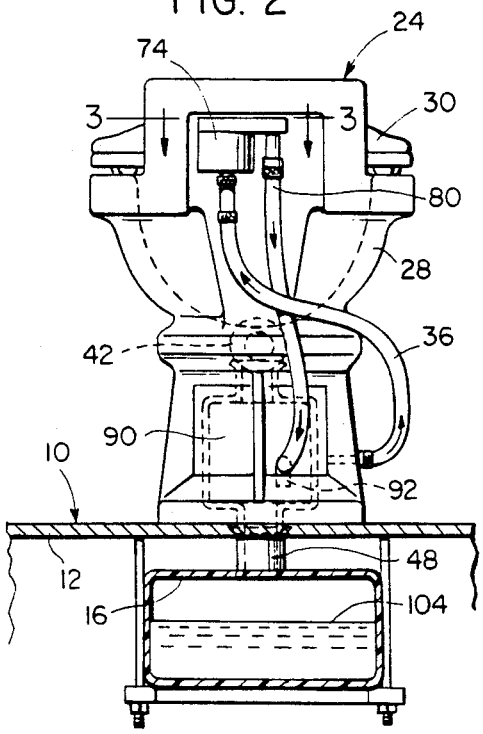
FIG. 2 is a rear elevational view of the R.V. toilet illustrated in FIG. 1 and with the holding tank of the toilet illustrated in vertical section.
Figure 7:
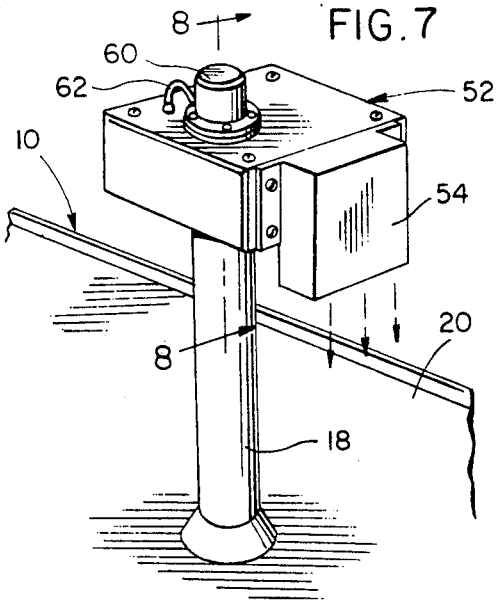
FIG. 7 is a fragmentary perspective view of the upper portion of an R.V. upwardly through which the holding tank vent pipe extends and illustrating an exhaust blower mounted atop the vent pipe.

Referring now more specifically to the drawings the numeral 10 generally designates a recreational vehicle including a floor 12 and an upstanding hollow wall 14. Mounted beneath the floor 12 is a holding tank 16 provided with an upstanding vent pipe 18 extending upwardly through the floor 12 and the hollow wall 14 and projecting above the roof or top 20 of the recreational vehicle 10.

The hollow wall 14 comprises one boundary wall of a bathroom 22 within the recreational vehicle 10 and the bathroom 22 includes a toilet assembly referred to in general by the reference numeral 24.

The toilet assembly 24 includes a hollow base 26 supported from the floor 12 above the holding tank 16 and a toilet bowl 28 is mounted upon the hollow base 26 and includes the usual toilet seat assembly 30 supported therefrom.

Conventionally, the hollow base encloses a flushing water control valve 32 serially connected within a water supply line 34 and a flexible hose or other conduit 36 extends from the control valve 32 to the flushing water inlet 38 of the toilet bowl 28, the flushing water inlet 38 opening into an upper bowl rim flushing channel 40 extending about the interior of the upper open end of the toilet bowl 28. Additionally, the lower portion of the interior of the toilet bowl 28 includes a rotary valve 42 mounted therein including a diametric passage 44 formed therethrough.

The toilet assembly 24 includes a pivotally mounted treadle 46 operatively connected both to the control valve 32 and the valve 42. When the treadle 46 is depressed, the valve 42 rotates 90 degrees to an open position communicating the lower portion of the interior of the bowl 28 with the hollow interior of the base 26, the base 26 opening downwardly into the inlet neck 48 of the holding tank 16. In addition, when the treadle 46 is depressed, the valve 32 is opened. This combined action allows the waste within the bottom of the interior of the bowl 28 to flow downwardly into the hollow interior of the base 26 and thereafter down into the holding tank 16 while at the same time flushing water passes through the hose 36 and into the channel 40 for discharge therefrom downwardly along the inner surfaces of the interior of the bowl and also downwardly through the valve 42, the interior of the base 26 and into the holding tank 16. When the treadle 46 is released for spring return upward to its uppermost limit position, the control valve 32 is closed and the valve 42 is also closed, any water remaining in the channel 40 thereafter flowing downwardly along the inner surfaces of the toilet bowl 28 and being retained in the bottom of the interior of the bowl 28 by the closed valve 42 with such remaining water ultimately assuming level 50 in the bottom of the interior of the bowl 28 above the valve 42.

The foregoing is to be considered as conventional recreational vehicle toilet assembly structure.

The venting system of the instant invention incorporates an exhaust blower assembly referred to in general by the reference numeral 52 mounted atop the vent pipe 18 above the roof or top 20 of the recreational vehicle 10. The exhaust blower assembly 52 is operative to draw gases upwardly through the vent pipe 18 and to discharge such gases outwardly and downwardly from the downwardly directed outlet 54 of the exhaust blower assembly 52.

Figure 8:
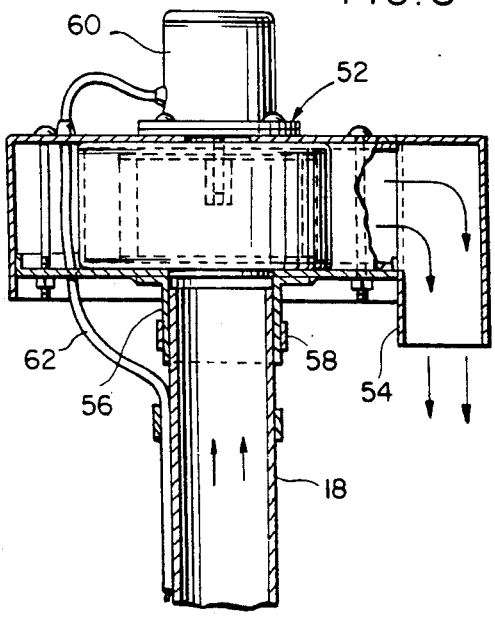
FIG. 8 is an enlarged fragmentary vertical sectional view taken substantially upon the plane indicated by the section line 8—8 of FIG. 7.
Figure 3:
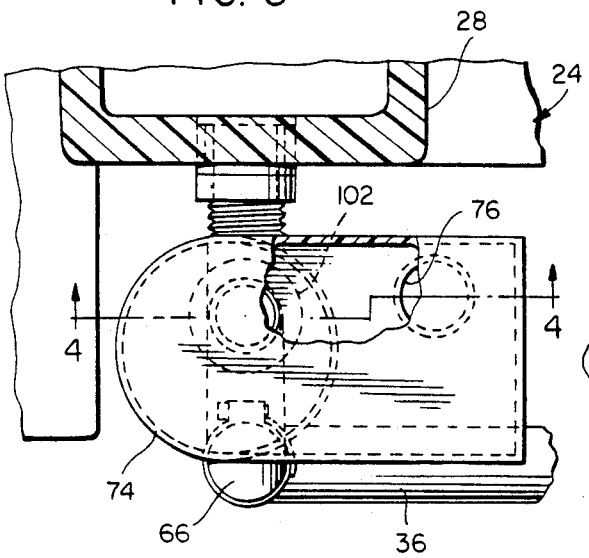
FIG. 3 is a fragmentary enlarged horizontal sectional view take substantially upon the plane indicated by the section line 3—3 of FIG. 2.
Figure 6:
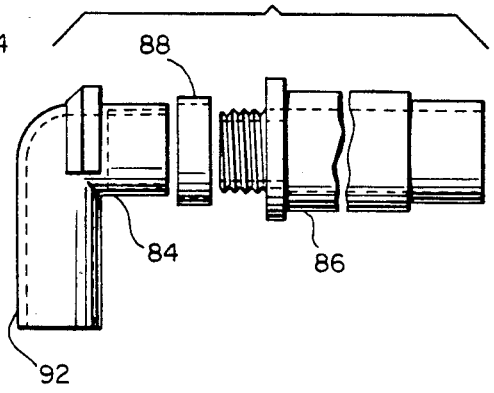
FIG. 6 is an exploded side elevational view of the outlet fitting for the vent line of the venting system.
Figure 4:
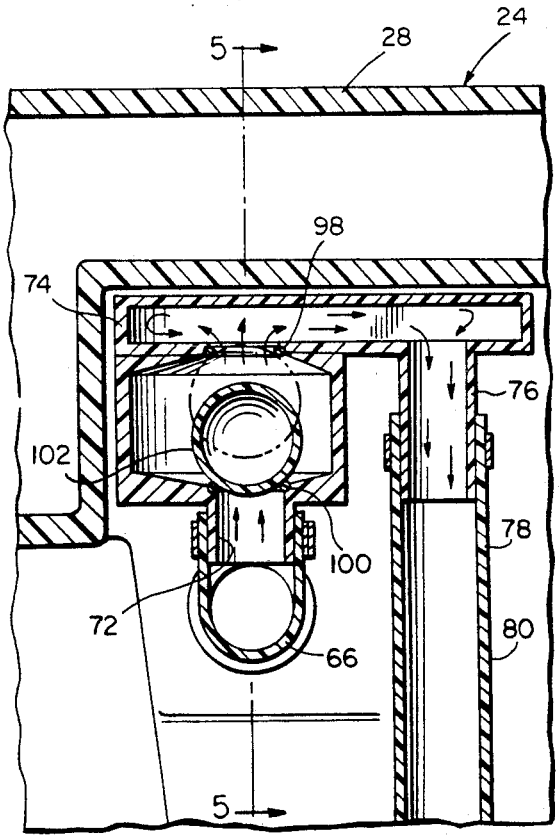
FIG. 4 is a fragmentary vertical sectional view taken substantially upon the plane indicated by the section line 4—4 of FIG. 3 and illustrating the float of the liquid flow preventing valve in an inoperative gas back flow preventing close position in solid lines and in a liquid flow preventing position in phantom lines.
Figure 5:
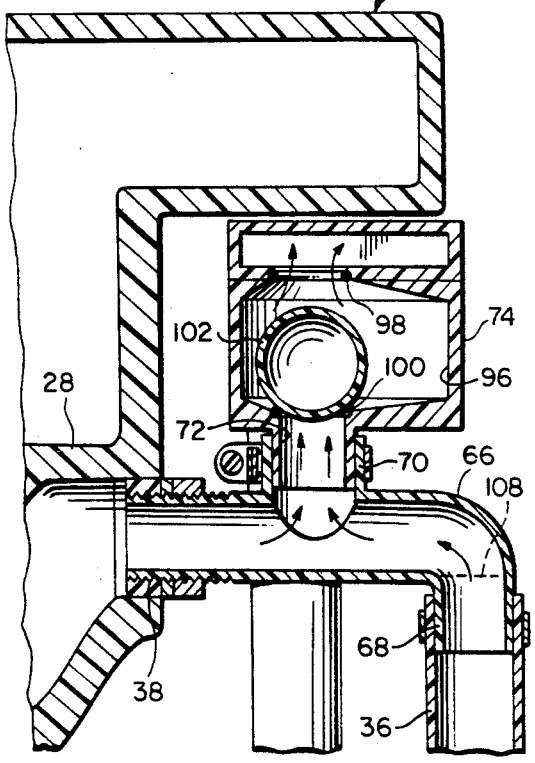
FIG. 5 is a vertical sectional view taken substantially upon the plane indicated by the section line 5—5 of FIG. 4.

As may be seen from FIG. 8 of the drawings, the exhaust blower assembly 52 includes an inlet fitting 56 which is telescoped downwardly over the upper end of the vent pipe 18 and secured thereon through the utilization of a suitable clamp 58, the blower assembly 52 including a drive motor 60 receiving current through a weatherproof electrical conductor cord 62. The electrical cord 62 receives current from the electrical system of the recreational vehicle 10 and has a control switch (not shown) serially connected therein and located at a point convenient for manual operation thereof by a person seated upon the toilet assembly 24.

The venting system also includes a T-fitting 66 including an outlet secured in the fresh water inlet 38, an inlet 68 to which the outlet end of the flexible hose 36 is connected and a branch outlet 70 to which the inlet 72 of a float-type liquid flow preventing valve 74 is connected, the valve 74 including a downwardly directed outlet 76 to which the inlet end 78 of a vent line 80 is connected.

The outlet end 82 of the vent line 80 is connected to the inlet end of an L-shaped fitting 84 through the utilization of a coupling fitting 86 and an axially compressible sealing ring 88. The fitting 84 is secured through the rear wall 90 of the hollow base 26. The fitting 84 includes a downwardly directed inlet end 92 disposed within the hollow interior of the base 26 and terminating downwardly a spaced distance above the lowermost extremities of the interior of the hollow base 26.

The float-type liquid flow preventing valve 74 includes a valve chamber 96 therein including vertically opposed upper and lower valve seats 98 and 100. A floatable ball-valve member 102 is disposed between the seats 98 and 100 and is gravity biased toward seated engagement with the seat 100. However, when flushing water is provided under pressure to the flushing water hose or conduit 36 and such flushing water passes into the fitting 66 under pressure, any water flowing upwardly through the inlet 72 of the valve 74 will enter the chamber 96 and float the valve member 102 off the seat 100 and up into seated engagement with the seat 98, thereby preventing further entrance of water into the chamber 96 and movement of any of the flushing water within the chamber 96 to escape therefrom past the valve seat 98. However, when a flushing operation is terminated, substantially all of the water within the chamber 96 drains therefrom in a reverse direction through the inlet 72 and the valve member 102 is seated by gravity against the seat 100, there being a small amount of water remaining in the lower portion of the chamber 96 about the contacting surfaces of the valve member 102 and the seat 100.

When the toilet assembly 24 is in use and electrical current is supplied to the motor 60, the blower assembly 52 is operative to reduce the pressure within the vent pipe 18, the upper portion of the interior of the holding tank 16 above the liquid level 104 therein, within the interior of the base 26, within the vent line 80 and within the chamber 96. This reduced pressure, in conjunction with atmospheric pressure within the fitting 66 above the water level 108 therein is sufficient to move the lightweight valve member 102 at least partially out of full seated engagement with the seat 100 to thereby allow gases to be drawn into the fitting 66 above the water level 108 therein from the interior of the flushing channel 40 and the upper portion of the interior of the toilet bowl 28 above the liquid level 50 therein.

When usage of the toilet assembly 24 has been completed, the aforementioned control switch serially connected within the weatherproof conductor 62 is opened in order to terminate operation of the blower assembly 52 and the treadle 46 is depressed so that the contents of the lower portion of the interior of the toilet bowl 24 may drain therefrom through the valve 40 and the hollow interior of the base 26 into the holding tank 16. While this drainage is occurring, the control valve 32 is operative to pass water under pressure therethrough into the flushing water hose 36, the fitting 66 and into the flushing channel 40 disposed about the interior of the upper portion of the toilet bowl 28. Thus, the toilet bowl 28 is flushed and, upon completion of the flushing action downward pressure applied to the treadle 46 may be released and the latter will then return upwardly to its uppermost limit position in order effect closing of the valve 42 as well as the valve 32.

This ventilating system is designed to equip all R.V. toilets on the market at the present time.

This system operates on D.C. power thus eliminating odors from the bowl to holding tank through the vent.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a toilet system including an upwardly opening toilet bowl having upper rim flushing water outlet means and a lower discharge outlet provided with a manually openable and closable valve, closed passage means communicating said discharge outlet with the interior of an upper portion of a holding tank disposed below said bowl and equipped with an upwardly projecting vent pipe including an upper discharge end, upper inner rim level flushing water supply means operative to supply flushing water to said flushing water outlet means and control valve means operative, responsive to manual opening of said valve, to supply water under pressure to said water supply means and to terminate the supply of water under pressure to said water supply means responsive to manual closing of said valve; the improvement including a remotely operable exhaust blower means operatively associated with said vent pipe for causing vapors to flow upwardly therethrough from within the upper portion of said holding tank and discharge of said vapors into the ambient atmosphere, a vent line having an inlet end and an outlet end opening into said closed passage means, a float-type liquid flow preventing valve communicating said inlet end with said flushing water supply means, said liquid flow preventing valve including fluid flow controlling means operative, in the absence of water under pressure flowing through said flushing water supply means, to allow reverse air and vapor flow through said flushing water outlet means, said flushing water supply means and into and through said liquid flow preventing valve into said vent line inlet end, and operative to prevent any flow of liquid through said liquid flow preventing valve from said flushing water supply means into said vent line inlet end in the presence of water under pressure flowing through said flushing water supply means.

2. The toilet system of claim 1 wherein said exhaust blower means includes a hollow housing closing the upper discharge end of said vent pipe and including a downwardly opening air and vapor discharge port spaced laterally of said upper discharge end.

3. The toilet system of claim 1 wherein said float-type liquid flow preventing valve includes means operative to block communication between said vent line and said flushing water supply means during periods of non-operation of said blower means and when said control valve means has terminated the supply of water under pressure.

4. A method of incorporating a toilet bowl vent within a toilet system including an upwardly opening toilet bowl having upper rim flushing water outlet means and a lower discharge outlet provided with a manually openable and closable valve, closed passage means communicating said discharge outlet with the interior of an upper portion of a holding tank disposed below said bowl and equipped with an upwardly projecting vent pipe including an upper discharge end, upper inner rim level flushing water supply means incorporated in said toilet bowl for supplying flushing water to said flushing water outlet means, and control valve means operative, responsive to manual opening of said control valve means; to supply water under pressure to said flushing water supply means and to terminate the supply of water under pressure to said flushing water supply means responsive to manual closing of said control valve means; said method including communicating an inlet of a remotely operable exhaust blower with the upper discharge end of said vent pipe, providing a float-type liquid flow preventing valve means, providing a vent line including inlet and outlet ends, communicating said outlet end with said closed passage means, communicating said inlet end with said flushing water supply means through said float-type liquid flow preventing valve means which is operative to allow low velocity downstream flow of air and vapors through said vent line, to prevent downstream flow of liquid through said vent line and to prevent upstream flow of air and vapor therethrough in the absence of water pressure within said flushing water supply means.

5. The toilet system of claim 1 wherein said outlet end of said vent line includes a fitting supported therefrom opening through a base of said toilet bowl and into said closed passage means in a downward direction therein.

6. The toilet system of claim 5 wherein said exhaust blower means includes a hollow housing closing the upper discharge end of said vent pipe and including a downwardly opening air and vapor discharge port spaced laterally of said upper discharge end.

7. The toilet system of claim 6 said float-type liquid flow preventing valve includes means operative to block communication between said vent line and said flushing water supply means during periods of non-operation of said blower means and when said control valve means has terminated the supply of water under pressure.

* * * * *